US007866777B2

(12) United States Patent
Azami

(10) Patent No.: US 7,866,777 B2
(45) Date of Patent: Jan. 11, 2011

(54) LIQUID EJECTING APPARATUS AND METHOD FOR CONTROLLING SAME

(75) Inventor: Nobuaki Azami, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 718 days.

(21) Appl. No.: 11/935,225

(22) Filed: Nov. 5, 2007

(65) Prior Publication Data

US 2008/0106558 A1 May 8, 2008

(30) Foreign Application Priority Data

Nov. 6, 2006 (JP) ..... 2006-300342

(51) Int. Cl.
*B41J 29/38* (2006.01)

(52) U.S. Cl. ..... 347/11; 347/5; 347/10

(58) Field of Classification Search ..... 347/11
See application file for complete search history.

(56) References Cited

U.S. PATENT DOCUMENTS 6,161,912 A * 12/2000 Kitahara et al. ..... 347/9

FOREIGN PATENT DOCUMENTS

| | | |
|---|---|---|
| JP | 11-020165 | 1/1999 |
| JP | 2000-094671 | 4/2000 |
| JP | 2000-094672 | 4/2000 |
| JP | 2001-105634 | 4/2001 |
| JP | 2002-113867 | 4/2002 |
| JP | 2002-127418 | 5/2002 |

* cited by examiner

*Primary Examiner*—Uyen-Chau N Le
*Assistant Examiner*—Kajli Prince
(74) *Attorney, Agent, or Firm*—Workman Nydegger

(57) ABSTRACT

A liquid ejecting apparatus includes a liquid ejecting head having a pressure chamber communicating with a nozzle opening and a pressure generator capable of causing pressure fluctuation to liquid in the pressure chamber, the liquid ejecting head causing pressure fluctuation to the liquid in the pressure chamber by driving the pressure generator, and discharging the liquid from the nozzle opening due to the pressure fluctuation, and a driver that supplies a discharge pulse to the pressure generator to drive the pressure generator. The discharge pulse that the driver generates includes a preliminary contracting element that contracts the pressure chamber without discharging a liquid droplet, a holding element that maintains the voltage at the end of the preliminary contracting element for a predetermined amount of time, a preliminary expanding element that changes the voltage so as to expand the pressure chamber to pull in the meniscus, and a discharging element that changes the voltage so as to contract the expanded pressure chamber to discharge a liquid droplet. The duration of the preliminary contracting element is set to the natural vibration period Tc of the pressure chamber or more, and the duration from the beginning of the preliminary contracting element to the end of the holding element is set to three times the natural vibration period Tc.

6 Claims, 4 Drawing Sheets

FIG. 5

| t1 | t2 | STABILITY |
|---|---|---|
| 3.25 | 3.25 | POOR |
| | 6.5 | POOR |
| | 9.75 | POOR |
| | 13 | POOR |
| | 16.25 | POOR |
| | 19.5 | GOOD |
| 6.5 | 3.25 | POOR |
| | 6.5 | POOR |
| | 9.75 | POOR |
| | 13 | GOOD |
| | 16.25 | GOOD |
| | 19.5 | GOOD |
| 9.75 | 3.25 | POOR |
| | 6.5 | POOR |
| | 9.75 | GOOD |
| | 13 | GOOD |
| | 16.25 | GOOD |
| | 19.5 | GOOD |
| 13 | 3.25 | POOR |
| | 6.5 | GOOD |
| | 9.75 | GOOD |
| | 13 | GOOD |
| | 16.25 | GOOD |
| | 19.5 | GOOD |

LIQUID EJECTING APPARATUS AND METHOD FOR CONTROLLING SAME

BACKGROUND

1. Technical Field

The present invention relates to a liquid ejecting apparatus such as an ink jet printer and to a method for controlling the same, and more specifically, it relates to a liquid ejecting apparatus having a liquid ejecting head that activates a piezoelectric vibrator by supplying a drive signal and that thereby discharges a liquid droplet from a nozzle opening, and to a method for controlling the same.

2. Related Art

Liquid ejecting apparatuses have a liquid ejecting head capable of discharging liquid in the form of liquid droplets, and discharge various liquids from the liquid ejecting head. Image recording apparatuses such as ink jet printers are representative liquid ejecting apparatuses. Ink jet printers discharge liquid ink in the form of ink droplets onto recording paper so as to form dots, thereby performing recording. In recent years, liquid ejecting apparatuses have been applied not only to the image recording apparatuses but also various manufacturing apparatuses such as display manufacturing apparatuses.

An ink jet printer (hereinafter referred to simply as printer) will be taken as an example. This printer has a recording head and a drive signal generating circuit (drive signal generator). The recording head includes ink flow paths and pressure generators (for example, piezoelectric vibrators). Each ink flow path extends from a common ink chamber (reservoir) through a pressure chamber to a nozzle opening. Each pressure generator fluctuates the volume of the corresponding pressure chamber. The drive signal generating circuit generates a drive signal to be supplied to each piezoelectric vibrator. The drive signal supplied from the drive signal generating circuit includes a drive pulse. The drive pulse drives each piezoelectric vibrator, thereby causing pressure fluctuation in ink in the corresponding pressure chamber. By using this pressure fluctuation, an ink droplet is discharged from a nozzle opening.

In this type of printer, the size of discharged ink droplets has been reduced to meet the demand for higher image quality. Reducing the size of ink droplets reduces the diameter of dots formed on a recording medium such as recording paper, thereby improving the image resolution and reducing graininess (roughness of an image) in a low-density region. In order to reduce the size of ink droplets, the diameter of nozzle openings can be reduced. However, if the diameter of nozzle openings is reduced, the manufacturing becomes difficult, the cost therefore increases, and the accuracy easily deteriorates. In addition, clogging due to dried ink in the vicinity of a nozzle opening easily occurs. Therefore, there is a limit to the reduction of the size of nozzle openings.

To solve this problem, there is proposed an art to reduce the size of ink droplets without changing the size of nozzle openings, by devising a drive signal for driving each piezoelectric vibrator, and thereby controlling the behavior of the meniscus when an ink droplet is discharged. For example, in an ink jet recording apparatus disclosed in JP-A-2002-127418, a drive signal includes a preliminary contraction signal prior to a preparation signal. The preliminary contraction signal contracts a pressure chamber so as to push out the meniscus. The preparation signal expands the pressure chamber so as to pull in the central part of the meniscus. Ink in the minute pulled-in central part of the meniscus is discharged in the form of an extremely minute ink droplet.

However, since the meniscus is vibrated more significantly compared to the case where the preliminary contraction is not performed, the discharge of this apparatus can be unstable. For example, the trajectory of the ink droplet can curve due to the vibration of the meniscus. In this regard, the time to supply a signal (holding signal) that is generated after the preliminary contraction signal and that maintains the voltage at the end of the preliminary contraction signal can be increased so that an ink droplet is discharged after the vibration of the meniscus after the preliminary contraction is minimized. However, in that case, the increased duration of the whole waveform makes high-frequency drive difficult.

SUMMARY

An advantage of some aspects of the invention is that a liquid ejecting apparatus capable of stably discharging a reduced-size liquid droplet and capable of high-frequency drive and a method for controlling the same are provided.

According to an aspect of the invention, a liquid ejecting apparatus includes a liquid ejecting head and a driver. The liquid ejecting head has a pressure chamber communicating with a nozzle opening, and a pressure generator capable of causing pressure fluctuation to liquid in the pressure chamber. The liquid ejecting head causes pressure fluctuation to the liquid in the pressure chamber by driving the pressure generator, and discharges the liquid from the nozzle opening due to the pressure fluctuation. The driver supplies a discharge pulse to the pressure generator to drive the pressure generator. The discharge pulse that the driver generates includes a preliminary contracting element that contracts the pressure chamber without discharging a liquid droplet, a holding element that maintains the voltage at the end of the preliminary contracting element for a predetermined amount of time, a preliminary expanding element that changes the voltage so as to expand the pressure chamber to pull in the meniscus, and a discharging element that changes the voltage so as to contract the expanded pressure chamber to discharge a liquid droplet. The duration of the preliminary contracting element is set to the natural vibration period Tc of the pressure chamber or more, and the duration from the beginning of the preliminary contracting element to the end of the holding element is set to three times the natural vibration period Tc.

Providing the preliminary contracting element and the holding element before the preliminary expanding element and the discharging element, setting the duration of the preliminary contracting element to the natural vibration period Tc of the pressure chamber or more, and setting the duration from the beginning of the preliminary contracting element to the end of the holding element to three times the natural vibration period Tc make it possible to stably discharge a reduced-size liquid droplet. That is, setting the duration of the preliminary contracting element to the natural vibration period Tc of the pressure chamber or more makes it possible to restrain the liquid in the pressure chamber from being unnecessarily vibrated during the preliminary contraction of the pressure chamber, and setting the duration from the beginning of the preliminary contracting element to the end of the holding element to three times the natural vibration period Tc makes it possible to minimize the amount of time required to damp the vibration of the meniscus generated by the preliminary contraction. Therefore, it is possible to reduce the size of liquid droplet, and to restrain the trajectory of liquid droplet from curving and the velocity of liquid droplet from fluctuating due to the vibration of the meniscus to stabilize the discharge operation. In addition, since the duration of the whole waveform is not unnecessarily increased, high-frequency drive is possible.

It is preferable that the amount of voltage change of the preliminary contracting element be set to 35% of the potential difference between the lowest voltage and the highest voltage in the discharge pulse. It is preferable that the amount of voltage change of the discharging element be set to 33% of the potential difference between the lowest voltage and the highest voltage in the discharge pulse.

According to another aspect of the invention, a method is for controlling a liquid ejecting apparatus. The apparatus includes a liquid ejecting head and a driver. The liquid ejecting head has a pressure chamber communicating with a nozzle opening, and a pressure generator capable of causing pressure fluctuation to liquid in the pressure chamber. The liquid ejecting head causes pressure fluctuation to the liquid in the pressure chamber by driving the pressure generator, and discharges the liquid from the nozzle opening due to the pressure fluctuation. The driver supplies a discharge pulse to the pressure generator to drive the pressure generator. The method includes preliminarily contracting the pressure chamber without discharging a liquid droplet, maintaining the contracted state of the pressure chamber for a predetermined amount of time, pulling in the meniscus by changing the voltage so as to expand the pressure chamber, and discharging a liquid droplet by changing the voltage so as to contract the expanded pressure chamber. The duration of the preliminary contracting is set to the natural vibration period Tc of the pressure chamber or more, and the duration from the beginning of the preliminary contracting to the end of the maintaining is set to three times the natural vibration period Tc.

Setting the duration of the preliminary contracting to the natural vibration period Tc of the pressure chamber or more and setting the duration from the beginning of the preliminary contracting to the end of the maintaining to three times the natural vibration period Tc make it possible to stably discharge a reduced-size liquid droplet. That is, setting the duration of the preliminary contracting to the natural vibration period Tc of the pressure chamber or more makes it possible to restrain the liquid in the pressure chamber from being unnecessarily vibrated during the preliminary contraction of the pressure chamber, and setting the duration from the beginning of the preliminary contracting to the end of the maintaining to three times the natural vibration period Tc makes it possible to minimize the amount of time required to damp the vibration of the meniscus generated by the preliminary contraction. Therefore, it is possible to reduce the size of liquid droplet, and to restrain the trajectory of liquid droplet from curving and the velocity of liquid droplet from fluctuating due to the vibration of the meniscus to stabilize the discharge operation. In addition, since the duration of the whole waveform is not unnecessarily increased, high-frequency drive is possible.

It is preferable that the amount of voltage change in the preliminary contracting be set to 35% of the potential difference between the lowest voltage and the highest voltage in the discharge pulse. It is preferable that the amount of voltage change in the discharging be set to 33% of the potential difference between the lowest voltage and the highest voltage in the discharge pulse.

BRIEF DESCRIPTION OF THE DRAWINGS

The invention will be described with reference to the accompanying drawings, wherein like numbers reference like elements.

FIG. 5 is a table showing the result of an experiment in which the stability of discharge of ink droplets was observed.

DESCRIPTION OF EXEMPLARY EMBODIMENTS

The exemplary embodiments of the invention will now be described with reference to the drawings. An ink jet printer (hereinafter referred to simply as printer) shown in FIG. 1 will be taken as an example of liquid ejecting apparatus of the invention.

Figure 1:
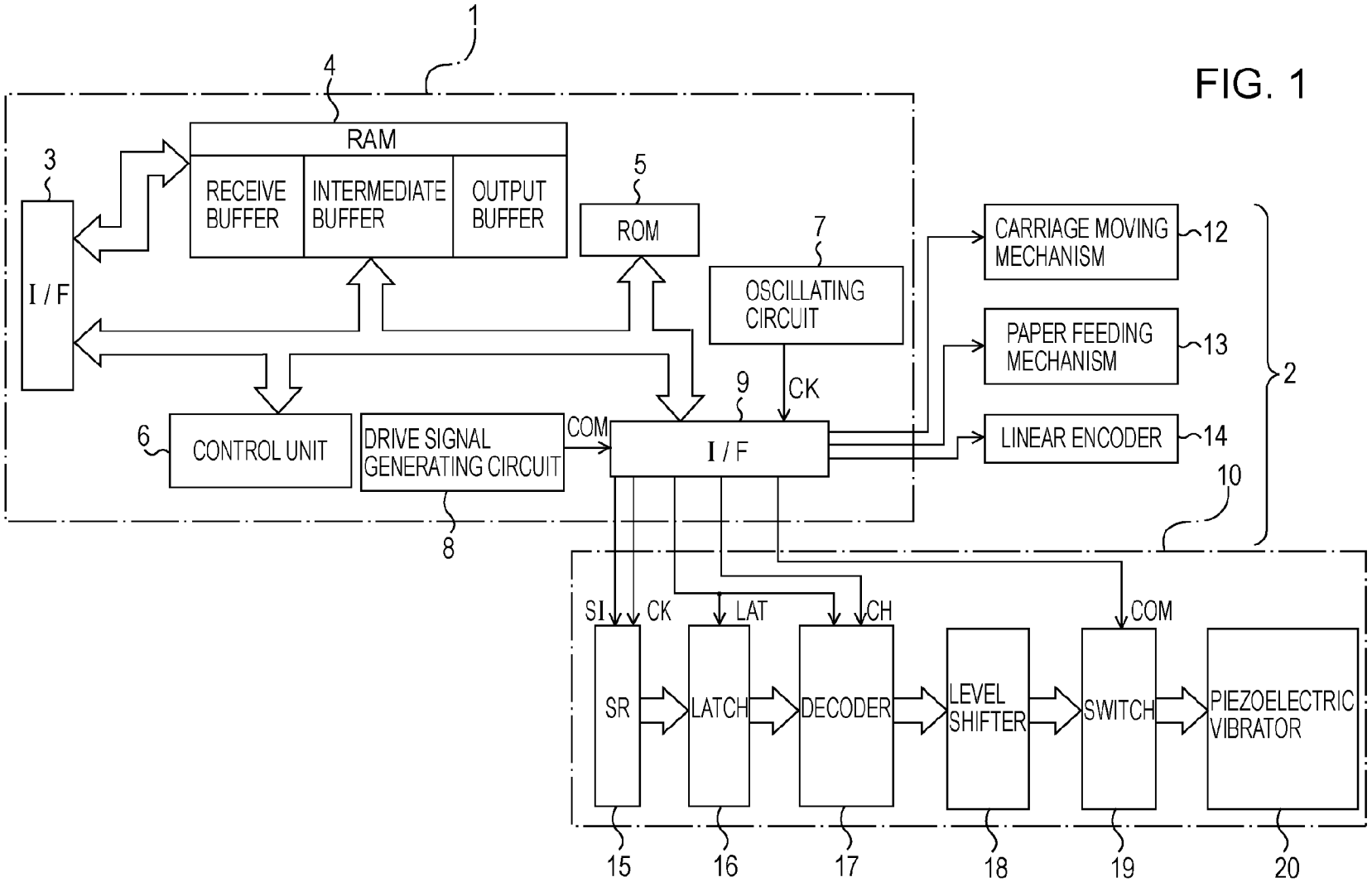
FIG. 1 is a block diagram showing the electric configuration of the printer.

FIG. 1 is a block diagram showing the electric configuration of the printer. The printer mainly includes a printer controller 1 and a print engine 2. The printer controller 1 includes an external interface (external I/F) 3, a RAM 4, a ROM 5, a control unit 6, an oscillating circuit 7, a drive signal generating circuit 8, and an internal interface (internal I/F) 9. The external I/F 3 exchanges data with an external device such as a host computer. The RAM 4 stores various data. The ROM 5 stores control routines for processing various data. The control unit 6 controls each section. The oscillating circuit 7 generates a clock signal. The drive signal generating circuit 8 generates a drive signal to be supplied to a recording head 10. The internal interface 11 outputs dot pattern data, the drive signal, and so forth to the recording head 10.

In addition to controlling each section, the control unit 6 converts print data received from the external device through the external I/F 3 into dot pattern data, and outputs the dot pattern data to the recording head 10 through the internal I/F 9. The dot pattern data is composed of print data obtained by decoding (translating) gradation data. The control unit 6 supplies a latch signal, a channel signal, and so forth to the recording head 10 on the basis of the clock signal from the oscillating circuit 7. A latch pulse and a channel pulse included in the latch signal and the channel signal define the timing of supply of each pulse constituting the drive signal.

Figure 2:
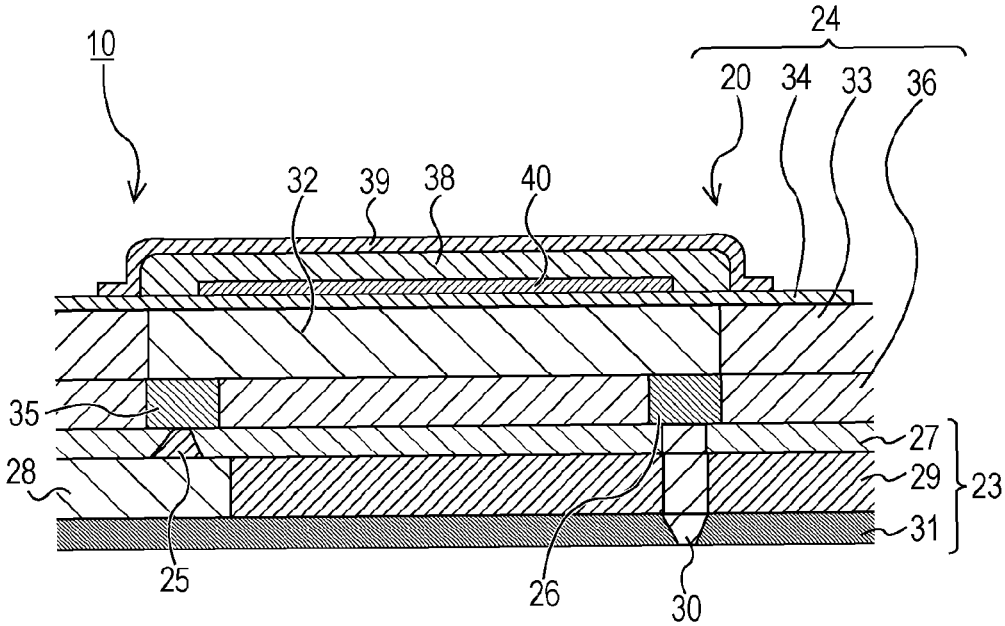
FIG. 2 is a schematic sectional view illustrating the structure of a recording head.

The drive signal generating circuit 8 is controlled by the control unit 6 and generates a drive signal for driving a piezoelectric vibrator 20 (see FIG. 2). The drive signal generating circuit 8 in this embodiment is configured to generate a drive signal COM that includes, in its one recording cycle, a discharge pulse and a minute vibration pulse. The discharge pulse is for discharging an ink droplet (a kind of liquid droplet) and thereby forming a dot on recording paper as a kind of object of discharge. The minute vibration pulse is for minutely vibrating the free surface, that is, the meniscus of ink (a kind of liquid) exposed in a nozzle opening 30 (see FIG. 2) and thereby stirring the ink.

Next, the configuration of the print engine 2 will be described. The print engine 2 includes a recording head 10, a carriage moving mechanism 12, a paper feeding mechanism 13, and a linear encoder 14. The recording head 10 includes a shift register (SR) 15, a latch 16, a decoder 17, a level shifter 18, a switch 19, and a piezoelectric vibrator 20. The dot pattern data (SI) from the printer controller 1 is serial-transmitted to the shift register 15 in synchronization with the clock signal (CK) from the oscillating circuit 7. The dot pattern data is 2-bit data and composed of gradation data that represents four recording gradations (discharge gradations)

including, for example, non-recording (minute vibration), a small dot, a middle dot, and a large dot. Specifically, the non-recording is represented by gradation data "00," the small dot is represented by gradation data "01," the middle dot is represented by gradation data "10," and the large dot is represented by gradation data "11."

The latch 16 is electrically connected to the shift register 15. When a latch signal (LAT) from the printer controller 1 is input into the latch 16, the latch 16 latches the dot pattern data of the shift register 15. The dot pattern data latched by the latch 16 is input into the decoder 17. The decoder 17 translates the 2-bit dot pattern data and generates pulse selection data. The pulse selection data is composed of bits corresponding to pulses that constitute the drive signal COM. Supply or non-supply of a discharge pulse to the piezoelectric vibrator 20 is selected according to the content of each bit, for example, "0" or "1."

Receiving a latch signal (LAT) or a channel signal (CH), the decoder 17 outputs the pulse selection data to the level shifter 18. In this case, the pulse selection data is input into the level shifter 18 with the highest-order bit first. The level shifter 18 functions as a voltage amplifier. When the pulse selection data is "1," the level shifter 18 outputs an electric signal amplified to a voltage capable of driving the switch 19, for example, a voltage of tens of volts. The pulse selection data of "1" amplified by the level shifter 18 is supplied to the switch 19. The input side of the switch 19 is supplied with a drive signal COM from the drive signal generating circuit 8. The output side of the switch 19 is connected to the piezoelectric vibrator 20.

The pulse selection data controls the operation of the switch 19, that is, the supply of a drive pulse in the drive signal to the piezoelectric vibrator 20. For example, while the pulse selection data input into the switch 19 is "1," the switch 19 is connected, a corresponding discharge pulse is supplied to the piezoelectric vibrator 20, and the potential of the piezoelectric vibrator 20 changes according to the waveform of the discharge pulse. While the pulse selection data is "0," no electric signal for activating the switch 19 is output from the level shifter 18. Therefore, the switch 19 is disconnected, and no discharge pulse is supplied to the piezoelectric vibrator 20.

The decoder 17, the level shifter 18, the switch 19, the control unit 6, and the drive signal generating circuit 8, which operate as above, function as drivers in the invention, select a necessary discharge pulse from the drive signal on the basis of the dot pattern data, and applies (supplies) the discharge pulse to the piezoelectric vibrator 20. As a result, the piezoelectric vibrator 20 extends or contracts. With the extension or contraction of the piezoelectric vibrator 20, a pressure chamber 32 (see FIG. 2) expands or contracts. An ink droplet whose size depends on the gradation data constituting the dot pattern data is thereby discharged from a nozzle opening.

FIG. 2 is a schematic sectional view illustrating the structure of the recording head 10. The recording head 10 in this embodiment mainly includes a flow path unit 23 and an actuator unit 24.

The flow path unit 23 includes a supply port forming substrate 27, an ink chamber forming substrate 29, and a nozzle substrate 31. The supply port forming substrate 27 has through holes each serving as an ink supply port 25 and through holes each serving as part of a nozzle communication port 26. The ink chamber forming substrate 29 has a through hole serving as a common ink chamber 28 (a kind of common liquid chamber) and through holes each serving as part of a nozzle communication port 26. The nozzle substrate 31 has nozzle openings 30. The supply port forming substrate 27, the ink chamber forming substrate 29, and the nozzle substrate 31 are formed, for example, by pressing a stainless steel sheet. The flow path unit 23 is formed by disposing the nozzle substrate 31 on one surface (the lower surface in FIG. 2) of the ink chamber forming substrate 29, disposing the supply port forming substrate 27 on the other surface (the upper surface in FIG. 2), and joining these.

The actuator unit 24 includes a pressure chamber forming substrate 33, a vibrating plate 34, a communication port substrate 36, and piezoelectric vibrators 20. The pressure chamber forming substrate 33 has through holes each serving as a pressure chamber 32. The vibrating plate 34 defines each pressure chamber 32. The communication port substrate 36 has communication holes each serving as part of a supply side communication port 35 and communication holes each serving as part of a nozzle communication port 26.

The actuator unit 24 is formed by disposing the communication port substrate 36 on one surface of the pressure chamber forming substrate 33, disposing the vibrating plate 34 on the other surface of the pressure chamber forming substrate 33, then joining these members, and thereafter forming the piezoelectric vibrators 20 on the surface of the vibrating plate 34. The pressure chamber forming substrate 33, the vibrating plate 34, and the communication port substrate 36 are formed of ceramics such as alumina or zirconium oxide and are joined by firing.

The piezoelectric vibrators 20 are so-called bending mode piezoelectric vibrators, and are formed on the surface of the vibrating plate 34 opposite the pressure chambers 32 one per pressure chamber 32. Each piezoelectric vibrator 20 has a multilayer structure including a drive electrode 39, a common electrode 40, and a piezoelectric body layer 38 therebetween. The drive electrode 39 is supplied with a drive signal, for example, through a flexible cable. The common electrode 40 is adjusted to the ground potential. Supplying a drive signal to the drive electrode 39 generates an electric field between the drive electrode 39 and the common electrode 40, the strength of the electric field depending on the potential difference therebetween. The electric field is applied to the piezoelectric body layer 38. The piezoelectric body layer 38 is deformed depending on the strength of the applied electric field. That is, with the increase in the potential of the drive electrode 39, the piezoelectric body layer 38 contracts in a direction perpendicular to the electric field and deforms the vibrating plate 34 so as to reduce the volume of the corresponding pressure chamber 32.

Figure 3:
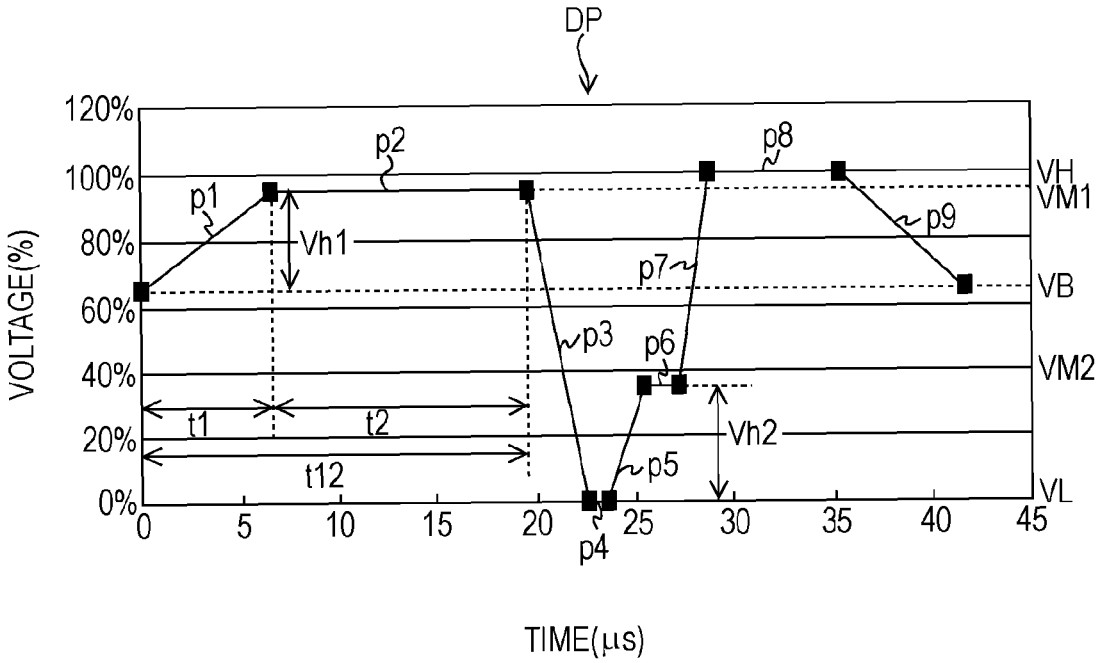
FIG. 3 is a waveform diagram illustrating the configuration of a discharge pulse.

FIG. 3 is a waveform diagram illustrating the configuration of the discharge pulse DP included in the drive signal COM generated by the drive signal generating circuit 8 configured as above. The exemplified discharge pulse DP is for discharging the smallest ink droplet dischargeable in the printer in this embodiment. The discharge pulse DP includes the following elements p1 to p9. A first electrical charging element p1 (which corresponds to a preliminary contracting element in the invention) raises the potential from a reference potential VB to an intermediate potential VM1 in a predetermined gradient. A first holding element p2 (which corresponds to a holding element in the invention) maintains the first intermediate potential VM1, which is the potential at the end of the first charging element p1, for a predetermined amount of time. A first electrical discharging element p3 (which corresponds to a preliminary expanding element in the invention) lowers the potential from the first intermediate potential VM1 to the lowest potential VL in a predetermined gradient. A second holding element p4 maintains the lowest potential VL for a very small amount of time. A second electrical charging element p5 (which corresponds to a discharging element in the invention) raises the potential from the lowest potential VL to a second intermediate potential VM2 in a comparatively steep gradient. A third holding element p6 maintains the second intermediate potential VM2 for a small amount of time. A third electrical charging element p7 raises the potential from the second intermediate potential VM2 to the highest potential VH in a predetermined gradient. A fourth holding element p8 maintains the highest potential VH for a predetermined amount of time. A second electrical discharging element p9 returns the potential from the highest potential VH to the reference potential VB in a predetermined gradient.

Figure 4A:
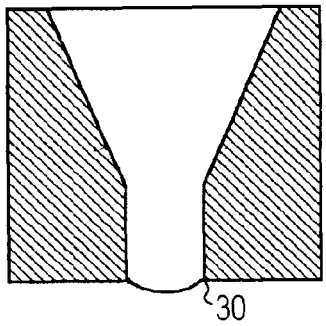
FIGS. 4A to 4D show the movement of the meniscus when an ink droplet is discharged.

When the discharge pulse DP is supplied to the piezoelectric vibrator 20, the piezoelectric vibrator 20 operates as follows. First, when the first electrical charging element p1 is supplied to the piezoelectric vibrator 20, the piezoelectric vibrator 20 bends toward the pressure chamber 32, and the pressure chamber 32 is thereby contracted from a reference volume corresponding to the reference potential VB to a volume corresponding to the intermediate potential VM1 (preliminary contraction step). The contraction of the pressure chamber 32 in this preliminary contraction step is slower than the contraction of the pressure chamber 32 in a below-described discharge contraction step. As shown in FIG. 4A, the meniscus is pushed out (away from the pressure chamber 32) but no ink droplet is discharged. In this preliminary contraction step, the pressure chamber 32 is preliminarily contracted so as to be significantly expanded by the first electrical discharging element p3. The contracted state of the pressure chamber 32 in the preliminary contraction step is maintained during the supply of the first holding element p2 (contraction maintenance step). This damps vibration of ink in the pressure chamber 32 generated by the contraction of the pressure chamber 32 in the preliminary contraction step.

Figure 4B:
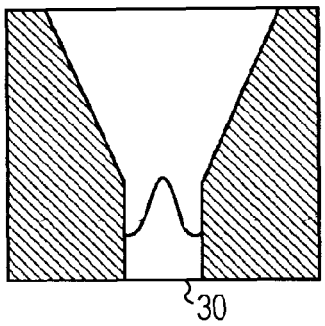

Following the first holding element p2, the first electrical discharging element p3 is supplied to the piezoelectric vibrator 20. The piezoelectric vibrator 20 bends away from the pressure chamber 32. The pressure chamber 32 is thereby expanded rapidly from the volume corresponding to the first intermediate potential VM1 to a volume defined by the lowest potential VL (preliminary expansion step). As shown in FIG. 4B, the meniscus in the nozzle opening 30, particularly the central part thereof is significantly pulled toward the pressure chamber 32. The reason is that the central part of the meniscus more easily moves and therefore more easily follows the pressure fluctuation than the peripheral part of the meniscus. Since the pressure chamber 32 is preliminarily contracted as described above, the meniscus is pulled in significantly in this preliminary expansion step. The expanded state of the pressure chamber 32 in the preliminary expansion step is maintained during the supply of the second holding element p4.

Figure 4C:
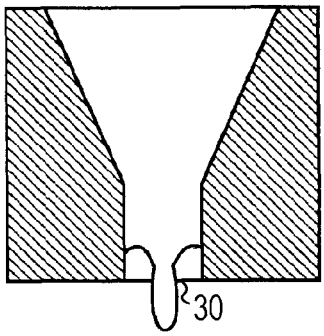
Figure 4D:
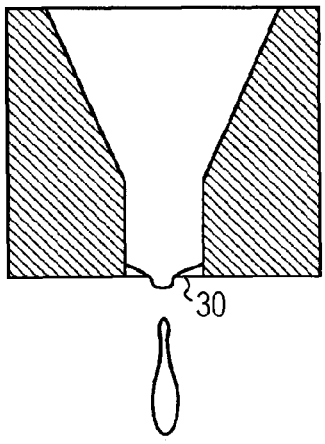

Thereafter, the second electrical charging element p5 is supplied to the piezoelectric vibrator 20. The piezoelectric vibrator 20 is thereby extended. The pressure chamber 32 is thereby expanded rapidly from the volume corresponding to the lowest potential VL to a volume corresponding to the second intermediate potential VM2 (discharge contraction step). This rapid contraction of the pressure chamber 32 presses ink in the pressure chamber 32, thereby protruding the central part of the meniscus like a column as shown in FIG. 4C. The contracted state of the pressure chamber 32 is maintained for a small amount of time during the supply of the third holding element p6. In this duration, as shown in FIG. 4D, the columnar part in the center of the meniscus breaks and is discharged from the nozzle opening 30 in the form of a droplet of several picoliters corresponding to a small dot.

Following the third holding element p6, when the meniscus is pulled toward the pressure chamber 32 as a reaction to discharge of the ink droplet, the third electrical charging element p7 is supplied to the piezoelectric vibrator 20. The supply of the third electrical charging element p7 further extends the piezoelectric vibrator 20, thereby contracting the pressure chamber 32 from the volume corresponding to the second intermediate potential VM2 to a volume defined by the highest potential VH (damping contraction step). This prevents the meniscus from being pulled toward the pressure chamber 32 so as to reduce vibration of the meniscus after the discharge. Next, the fourth holding element p8 is supplied to the piezoelectric vibrator 20, and the highest potential VH is maintained for a predetermined amount of time. Thereafter, the second electrical discharging element p9 is supplied to the piezoelectric vibrator 20, and the pressure chamber 32 returns from the volume corresponding to the highest potential VH to the volume corresponding to the reference potential VB.

As described above, in the ink-droplet discharging operation using the discharge pulse DP shown in FIG. 3, the pressure chamber 32 is contracted (preliminary contraction) by the first electrical charging element p1 and is then significantly expanded by the first electrical discharging element p3, thereby pulling in the central part of the meniscus. After being pulled in, the meniscus is rapidly pressed by the second electrical charging element p5. Therefore, ink in the central part of the meniscus is discharged in the form of an ink droplet. Thus, a reduced-size ink droplet is rapidly discharged.

However, since the meniscus is vibrated more significantly compared to the case where the preliminary contraction step is not performed, the discharge can be unstable. For example, the trajectory of the ink droplet can curve due to the vibration of the meniscus. In this regard, the time to supply the first holding element p2 can be increased so that an ink droplet is discharged after the vibration of the meniscus generated in the preliminary contraction step is minimized. However, in that case, the elongated waveform of the whole discharge pulse DP makes high-frequency drive difficult.

In consideration of the above, in the printer 1 according to the invention, the waveform elements of the discharge pulse DP are optimized so that the size of ink droplets is reduced, and so that the residual vibration after discharge is restrained and thereby ink droplets are stably discharged. Specifically, in the discharge pulse DP, the duration t1 of the first electrical charging element p1 (that is, the duration of the preliminary contraction step) is set to the natural vibration period Tc of the pressure chamber 32 or more, and the duration t2 from the beginning of the first electrical charging element p1 to the end of the first holding element p2 (that is, the duration from the beginning of the preliminary contraction step to the end of the contraction maintenance step) is set to three times the natural vibration period Tc.

When a predetermined voltage change (for example, a voltage change from the reference potential VB to the first intermediate potential VM1) is given to the piezoelectric vibrator 20 in an amount of time less than the natural vibration period Tc, a vibration of the natural vibration period Tc is applied to ink in the pressure chamber 32, and thereby the meniscus is unnecessarily vibrated. Therefore, in the case where the duration t1 of the first electrical charging element p1 is set to the natural vibration period Tc or less, the vibration of the meniscus generated in the preliminary contraction step by the first electrical charging element p1 can adversely affect the subsequent discharge of an ink droplet (preliminary expansion step, discharge contraction step). In contrast, when the voltage is changed in an amount of time sufficiently greater than the natural vibration period Tc, the vibration of the natural vibration period Tc can be restrained. Therefore, setting the duration t1 of the first electrical charging element p1 to the natural vibration period Tc or more can minimize the unnecessary vibration in the preliminary contraction step. In addition, providing the first holding element p2 after the first electrical charging element p1 and maintaining the contracted state of the pressure chamber 32 for a predetermined amount of time with the first holding element p2 can damp some vibration in the preliminary contraction step, if any, before the preliminary expansion step due to the first electrical discharging element p3 is started.

However, setting the duration t1 of the first electrical charging element p1 and/or the duration of the first holding element p2 unnecessarily large increases the duration of the whole discharge pulse DP. Therefore, in addition to setting the duration t1 of the first electrical charging element p1 to the natural vibration period Tc or more, setting the duration t12 from the beginning of the first electrical charging element p1 to the end of the first holding element p2 to three times the natural vibration period Tc is adopted as a condition in which the vibration in the preliminary contraction step can be restrained and the waveform length of the whole discharge pulse DP can be minimized. These conditions were determined on the basis of the result of an actual experiment.

FIG. 5 is a table showing the result of the experiment in which the duration t1 of the first electrical charging element p1 and the duration t2 of the first holding element p2 in the discharge pulse DP were changed and the stability of discharge of ink droplets was observed. In this experiment, the amount of voltage change Vh1 of the first electrical charging element p1 was set to 35% of the potential difference between the lowest voltage VL and the highest voltage VH of the discharge pulse DP, and the amount of voltage change Vh2 of the second electrical charging element p5 was set to 33% of the potential difference between the lowest voltage VL and the highest voltage VH. The natural vibration period Tc of the pressure chamber 32 was 6.5 μs. The experimenter observed actually discharged ink droplets to determine the stability of discharge of ink droplets. A state where trajectories of an ink droplet and satellite ink droplets accompanying the ink droplet do not curve is referred to as a stable state.

The case where the duration t1 of the first electrical charging element p1 is set to 3.25 μs, that is, the case where t1 is shorter than Tc shows that stable discharge is impossible unless the duration t2 of the first holding element p2 is 19.5 μs or more. That is, in order to stabilize the discharge, it is necessary to set the duration t12 from the beginning of the first electrical charging element p1 to the end of the first holding element p2 to at least 22.75 μs. In this case, the duration t12 is longer than three times the natural vibration period Tc (19.5 μs (Tc is 6.5 μs in this embodiment)), thereby increasing the waveform length of the whole discharge pulse DP.

In contrast, in the case where the duration t1 of the first electrical charging element p1 is set to the natural vibration period Tc or more, for example, in the case where t1 is equal to Tc (6.5 μs), the discharge can be stabilized by setting the duration t2 of the first holding element p2 to 13 μs or more. In the case where the duration t1 is set to 9.75 μs, the discharge can be stabilized by setting the duration t2 to 9.75 μs or more. In the case where the duration t1 is set to 13 μs, the discharge can be stabilized by setting the duration t2 to 6.5 μs or more. In each case, the discharge can be stabilized in the smallest duration by setting the sum of t1 and t2, that is, the duration t12 from the beginning of the first electrical charging element p1 to the end of the first holding element p2 to three times Tc (19.5 μs).

The above shows that setting the duration t1 of the first electrical charging element p1 to the natural vibration period Tc or more and setting the duration t12 from the beginning of the first electrical charging element p1 to the end of the first holding element p2 to three times the natural vibration period Tc can stabilize the discharge with the duration of the whole waveform of the discharge pulse DP minimized.

Therefore, even in the case where a preliminary contraction is performed by the first electrical charging element p1 to reduce the size of ink droplets, setting the duration t1 of the first electrical charging element p1 to the natural vibration period Tc of the pressure chamber 32 or more makes it possible to restrain the ink in the pressure chamber from being unnecessarily vibrated during the preliminary contraction of the pressure chamber 32, and setting the duration t12 from the beginning of the first electrical charging element p1 to the end of the first holding element p2 to three times the natural vibration period Tc makes it possible to minimize the amount of time required to damp the vibration of the meniscus generated by the preliminary contraction. Therefore, it is possible to reduce the size of ink droplets and to restrain the trajectories of ink droplets from curving and the velocity of ink droplets from fluctuating due to the vibration of the meniscus. Since the duration of the whole waveform of the discharge pulse DP is not unnecessarily increased, high-frequency drive is possible.

It is to be understood that the invention is not intended to be limited to the above-described embodiments, and various changes may be made therein within departing from the spirit and scope of the invention.

For example, the waveform of the discharge pulse in the invention is not limited to that shown in FIG. 3. Any waveform can be used as long as it includes a preliminary contracting element (first electrical charging element p1) and a holding element (first holding element p2) that maintains the voltage at the end of the preliminary contracting element for a predetermined amount of time prior to a preliminary expansion element (first electrical discharging element p3) and a discharging element (second electrical charging element p5).

Although a so-called bending vibration mode piezoelectric vibrator 20 is exemplified as a pressure generator, the invention is not limited to this. The invention can also be applied, for example, to a case where a so-called vertical vibration mode piezoelectric vibrator is used. In this case, the waveform of the discharge pulse DP shown in FIG. 3 is vertically inverted.

The invention can also be applied to liquid ejecting apparatuses other than the above-described printer, for example, display manufacturing apparatuses, electrode manufacturing apparatuses, and chip manufacturing apparatuses.

What is claimed is:

1. A liquid ejecting apparatus comprising:

a liquid ejecting head having a pressure chamber communicating with a nozzle opening and a pressure generator capable of causing pressure fluctuation to liquid in the pressure chamber, the liquid ejecting head causing pressure fluctuation to the liquid in the pressure chamber by driving the pressure generator, and discharging the liquid from the nozzle opening due to the pressure fluctuation; and a driver controlled by a controller that supplies a discharge pulse to the pressure generator to drive the pressure generator, wherein the discharge pulse that the driver generates includes a preliminary contracting element that contracts the pressure chamber without discharging a liquid droplet, a holding element that maintains the voltage at the end of the preliminary contracting element for a predetermined amount of time, a preliminary expanding element that changes the voltage so as to expand the pressure chamber, and a discharging element that changes the voltage so as to contract the expanded pressure chamber to discharge a liquid droplet, and the duration of the preliminary contracting element is set to the natural vibration period Tc of the pressure chamber or more, and the duration from the beginning of the preliminary contracting element to the end of the holding element is set to three times the natural vibration period Tc.

2. The liquid ejecting apparatus according to claim 1, wherein the amount of voltage change of the preliminary contracting element is set to 35% of the potential difference between the lowest voltage and the highest voltage in the discharge pulse.

3. The liquid ejecting apparatus according to claim 1, wherein the amount of voltage change of the discharging element is set to 33% of the potential difference between the lowest voltage and the highest voltage in the discharge pulse.

4. A method for controlling a liquid ejecting apparatus including:

a liquid ejecting head having a pressure chamber communicating with a nozzle opening and a pressure generator capable of causing pressure fluctuation to liquid in the pressure chamber, the liquid ejecting head causing pressure fluctuation to the liquid in the pressure chamber by driving the pressure generator, and discharging the liquid from the nozzle opening due to the pressure fluctuation; and a driver that supplies a discharge pulse to the pressure generator to drive the pressure generator, the method comprising:

preliminarily contracting the pressure chamber without discharging a liquid droplet;

maintaining the contracted state of the pressure chamber for a predetermined amount of time;

preliminarily expanding the pressure chamber by changing the voltage; and discharging a liquid droplet by changing the voltage so as to contract the expanded pressure chamber, wherein the duration of the preliminary contracting is set to the natural vibration period Tc of the pressure chamber or more, and the duration from the beginning of the preliminary contracting to the end of the maintaining is set to three times the natural vibration period Tc.

5. The method according to claim 4, wherein the amount of voltage change in the preliminary contracting is set to 35% of the potential difference between the lowest voltage and the highest voltage in the discharge pulse.

6. The method according to claim 4, wherein the amount of voltage change in the discharging is set to 33% of the potential difference between the lowest voltage and the highest voltage in the discharge pulse.

* * * * *